United States Patent [19]

Lacoste

[11] 3,941,380

[45] Mar. 2, 1976

[54] TENNIS RACKETS AND SIMILAR IMPLEMENTS WITH VIBRATION DAMPER

[75] Inventor: Francois René Lacoste, Neuilly, Hauts de Seine, France

[73] Assignee: Patentex S.A., Fribourg, Switzerland

[22] Filed: July 12, 1973

[21] Appl. No.: 378,713

[30] Foreign Application Priority Data

| | | |
|---|---|---|
| July 31, 1972 | France | 72.27538 |
| Oct. 20, 1972 | France | 72.37231 |
| June 6, 1973 | France | 73.20527 |

[52] U.S. Cl. ..... 273/72 A; 273/73 R; 273/73 G; 273/73 J

[51] Int. Cl.[2] ..... A63B 59/06; A63B 49/02

[58] Field of Search .... 273/67 R, 72 A, 73 R, 73 C, 273/73 D, 73 J, 73 H, 80 R, 80 B, 82 R, 82 A; 174/42, 402, 403, 409, 410, 457; 124/23 R, 24 R, 30 R; 408/143; 248/358 R, 20, 18, 22, 23; 188/1 B; 73/67, 430; 74/604, 573, 574, 5.5; 64/1 V; 173/162; 145/61 R

[56] References Cited

UNITED STATES PATENTS

| | | | |
|---|---|---|---|
| 1,526,734 | 2/1925 | Andrews et al. | 273/73 J X |
| 1,587,918 | 6/1926 | Morrison | 273/73 J |
| 1,934,597 | 11/1933 | Foppl | 64/1 V X |
| 2,023,131 | 12/1935 | Gibson | 273/72 A UX |
| 2,396,847 | 3/1946 | Hathaway | 188/1 B X |
| 2,534,963 | 12/1950 | Fowler | 188/1 B X |
| 2,544,450 | 3/1951 | Enos | 273/72 A UX |
| 2,586,043 | 2/1952 | Hodgson et al. | 188/1 B |
| 2,599,539 | 6/1952 | Boyd et al. | 188/1 B X |
| 2,631,690 | 3/1953 | Dunham | 188/1 B |
| 3,075,406 | 1/1963 | Butler et al. | 64/1 V UX |
| 3,138,380 | 6/1964 | Satchell et al. | 273/82 A |
| 3,210,765 | 10/1965 | Jones | 174/42 X |
| 3,314,503 | 4/1967 | Neubert | 248/358 R X |
| 3,388,772 | 6/1968 | Marsh et al. | 188/1 B |
| 3,401,911 | 9/1968 | Lazan | 188/1 B X |
| 3,412,725 | 11/1968 | Hoyt | 124/30 R X |
| 3,430,902 | 3/1969 | Lohr | 248/358 R |
| 3,478,160 | 11/1969 | Reed | 248/358 R X |
| 3,479,030 | 11/1969 | Merola | 273/72 A |
| 3,487,888 | 1/1970 | Adams et al. | 248/358 R X |
| 3,524,441 | 8/1970 | Jeffery | 124/24 R |
| 3,525,322 | 8/1970 | Lee | 124/24 R |
| 3,612,526 | 10/1971 | Brull | 273/73 J X |
| 3,633,910 | 1/1972 | Spenle | 273/73 J |
| 3,729,196 | 4/1973 | Heald | 273/72 A |
| 3,757,761 | 9/1973 | Izuta | 124/23 R |

FOREIGN PATENTS OR APPLICATIONS

| | | | |
|---|---|---|---|
| 2,106,800 | 9/1971 | Germany | 273/73 C |
| 310,566 | 5/1929 | United Kingdom | 273/73 C |
| 1,526,906 | 4/1968 | France | 273/73 J |
| 1,181,560 | 11/1964 | Germany | 64/1 V |
| 498,430 | 1/1939 | United Kingdom | 273/73 J |

*Primary Examiner*—Richard J. Apley
*Attorney, Agent, or Firm*—Merriam, Marshall, Shapiro & Klose

[57] ABSTRACT

A damping mechanism for implements such as tennis rackets, baseball bats and the like, comprising an elongated vibratable member formed of an elastomeric, energy-absorbing material. One of the ends of the vibratable member is attached rigidly to the implement at a point near an anti-node, with the longitudinal axis of the member concentric with or generally parallel to the longitudinal axis of the implement. The dimensions of the member are adjusted such that the natural frequency of vibration of the member corresponds generally to the vibration induced in the implement in use as a result of striking a game ball or the like.

24 Claims, 31 Drawing Figures

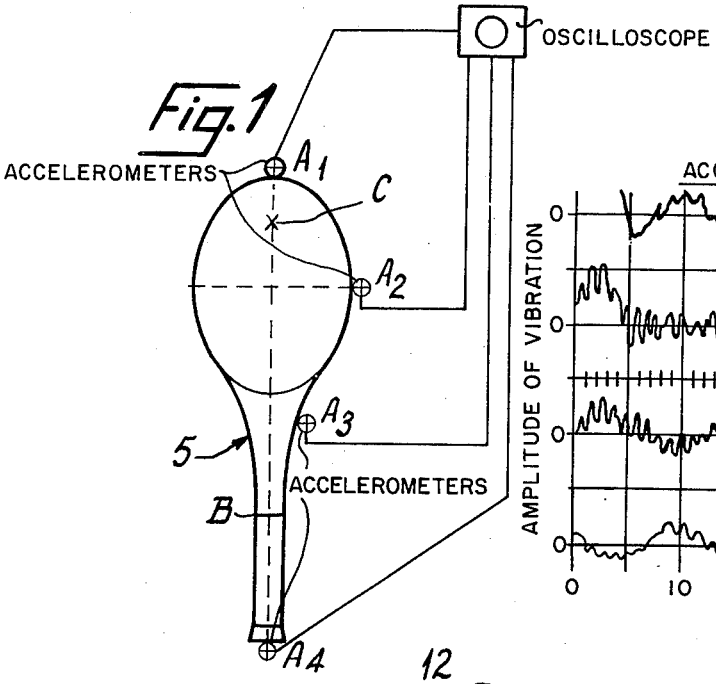
Fig. 1
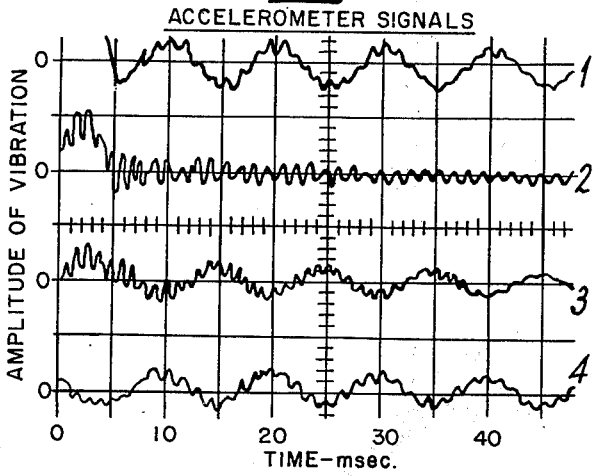
Fig. 2
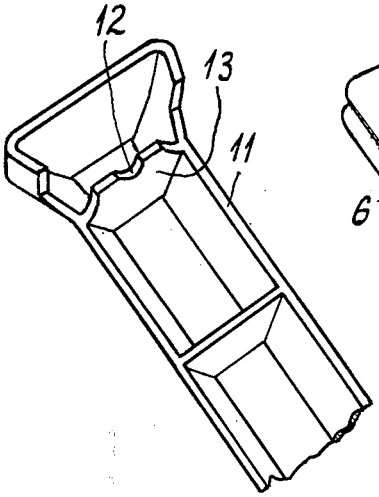
Fig. 5
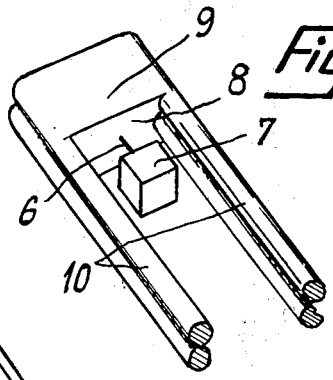
Fig. 3
Fig. 6
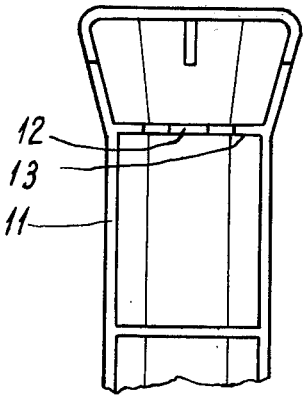
Fig. 4
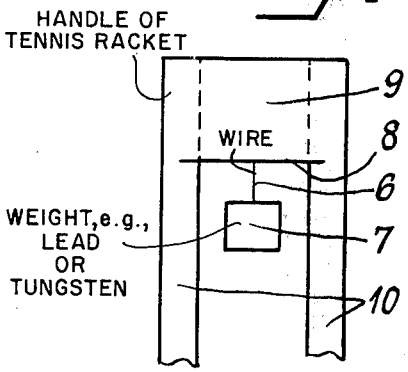

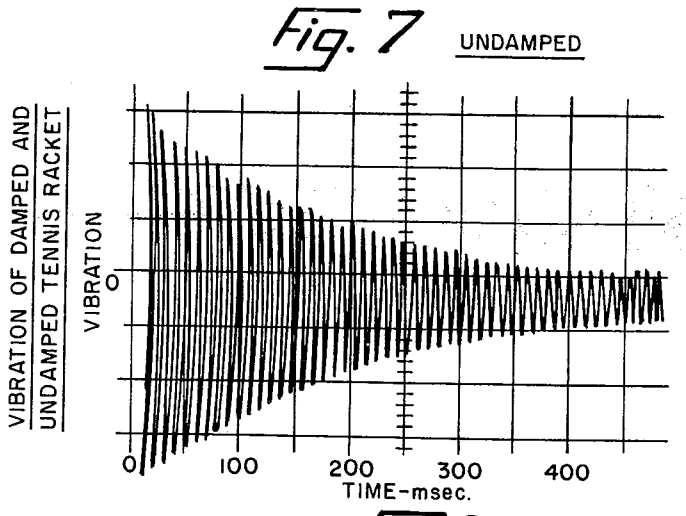
Fig. 7 UNDAMPED
VIBRATION OF DAMPED AND UNDAMPED TENNIS RACKET
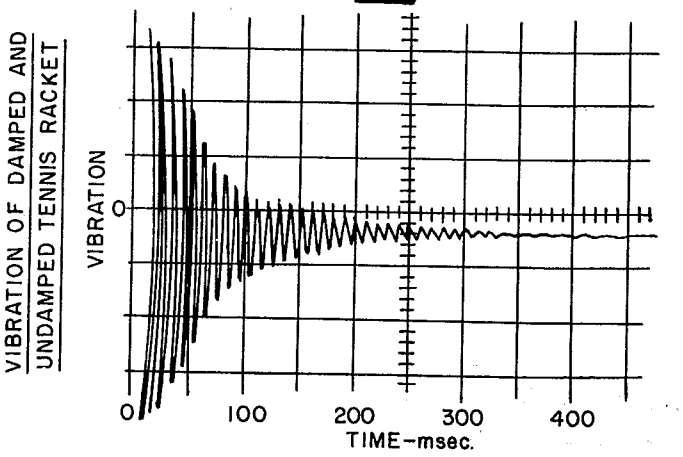
Fig. 8 DAMPED
VIBRATION OF DAMPED AND UNDAMPED TENNIS RACKET
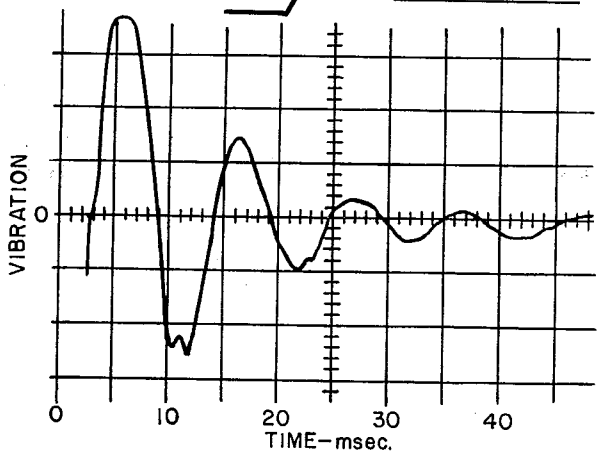
Fig. 9 TUNED DAMPER
EFFECT OF CHANGE IN DAMPING FREQUENCY
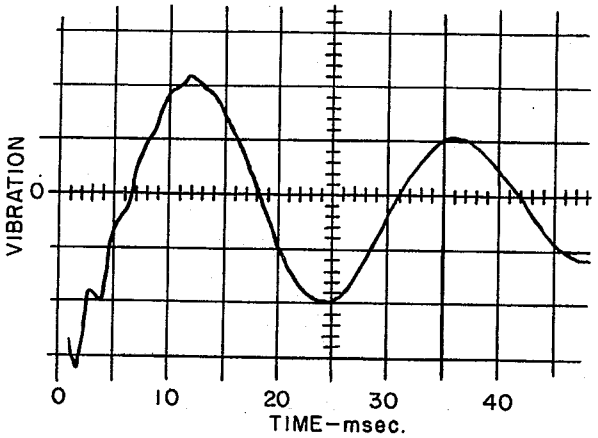
Fig. 10 DETUNED DAMPER
EFFECT OF CHANGE IN DAMPING FREQUENCY

SET-UP FOR TESTING DAMPING MATERIALS

RESONANCE CURVE OF TYPICAL DAMPING MATERIAL

VIBRATION OF DAMPED TENNIS RACKET

VIBRATION OF DAMPED AND UNDAMPED BASEBALL BAT

TENNIS RACKETS AND SIMILAR IMPLEMENTS WITH VIBRATION DAMPER

The present relates to tennis rackets, baseball bats and other similar implements.

When an implement like a tennis racket or a baseball bat is submitted to a shock, like the striking of a ball, it begins to vibrate.

The vibrations noticed vary according to:

— the part of the implement and the way in which it is held or attached to a supporting element, — the part of the implement which has been struck.

In current use for the game of tennis, a racket is held by the hand of the player near the end of the handle and the ball strikes the stringing near its center.

In this case, one notices mainly two kinds of vibrations which are the following:

1. vibrations of relatively high frequency (1000 hertz for example) resulting from the impulsion given to the strings by the striking ball. These vibrations which are easily perceived when one brings the racket near his ear, soon after the ball has been struck, last normally several seconds but one can stop them immediately by placing a finger on any point of the stringing. Practically these vibrations do not appear to cause any inconvenience to the player.

2. vibrations of a frequency clearly lower than the former (100 hertz for example) which are perceived by the ear but also by touching certain parts of the racket: the end of the finger used then feels a characteristic tickling.

While the vibrations of the stringing are noticed whatever the spot struck by the ball, the vibrations of the frame, negligible if the striking happens in the center of the stringing, became very clear as soon as the spot struck is several centimeters from the center. The amplitude of these vibrations can often exceed 1 millimeter and this gives a disagreeable feeling to the player because of the tickle felt at the surface of the hand or of the vibration transmitted all along the arm. To fight it, the player can be brought instinctively to tighten his grip more then necessary which is a cause of more fatigue.

In current use, for the game of baseball, a bat is held with both hands by the player near the end of the handle and the ball strikes the cylindrical part of the bat near its center.

In this case one notices only a principal vibration, the frequency of which is comprised between about 150 and 300 hertz according to the kind of bat, which is easily audible and the amplitude of which is initially parallel to the direction of striking. If the striking of the ball is eccentric, the vibration produced gives, as for tennis, a disagreeable feeling in the hands of the player, said feeling being even in some cases more unpleasant due to the violence with which the ball is struck in the game of baseball.

While the replacement of wood by some metal to manufacture the structure of a racket or of a similar implement, offers indisputable advantages concerning its strength, its resiliency and the lower aerodynamical resistance, the lower absorption inherent to the metal increases the inconveniencies of the vibrations of the implement, to such a degree that some manufacturers ask themselves if they should not renounce to use metal or adopt structures thicker and less resilient having vibrations with higher frequencies, thus less annoying and with a faster amortization.

The object of the present invention is to reduce as much as possible the inconvenience of the vibrations of the implement not by any change in the shape or structure of the said implement but by addition of a simple amortizing or damping system properly adapted to the characteristics of these vibrations.

The description which will follow, according to the attached designs, will clearly explain how the invention may be achieved.

FIG. 1 is a schematic view of a racket showing the spots where have been attached 4 miniaturized accelerometers used to study the vibrations of this racket.

FIG. 2 is a chart showing, in relation to time, the amplitude of the vibrations transmitted by the 4 accelerometers of FIG. 1 to an oscilloscope connected with them.

FIG. 3 is a perspective view and FIG. 4 is a cut out view of the end of the frame of a metal racket constituting the handle, with an amortizing system according to the invention.

FIGS. 5 and 6 are views similar to the last ones of a shell made to complete the handle of the racket and modified to permit the mounting of the amortizing system.

FIGS. 7 and 8 are charts established like the chart shown by FIG. 2 and relating, the first one, to a racket without amortizing system, the other one to a racket identical but with the amortizing system shown by FIGS. 3 and 4.

FIGS. 9 and 10 are also showing the amplitude of the vibration in relation to time but relating, in this case, the first one to a racket with its amortizing system set in order to amortize as best as possible the vibrations of the racket, the other one to a racket in which the setting of the amortizing system has been put out of order by placing the small weight a little further away from the supporting element.

Figure 11:
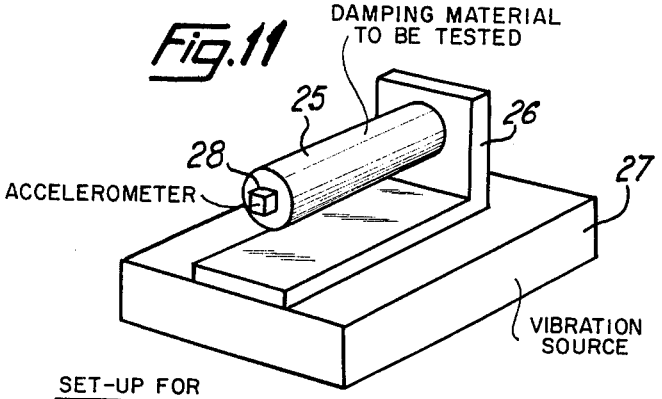

FIG. 11 is a schematic perspective view of an experimental set-up, used for systematically studying the characteristics of the amortizing systems and of the materials out of which the said systems are made.

Figure 12:
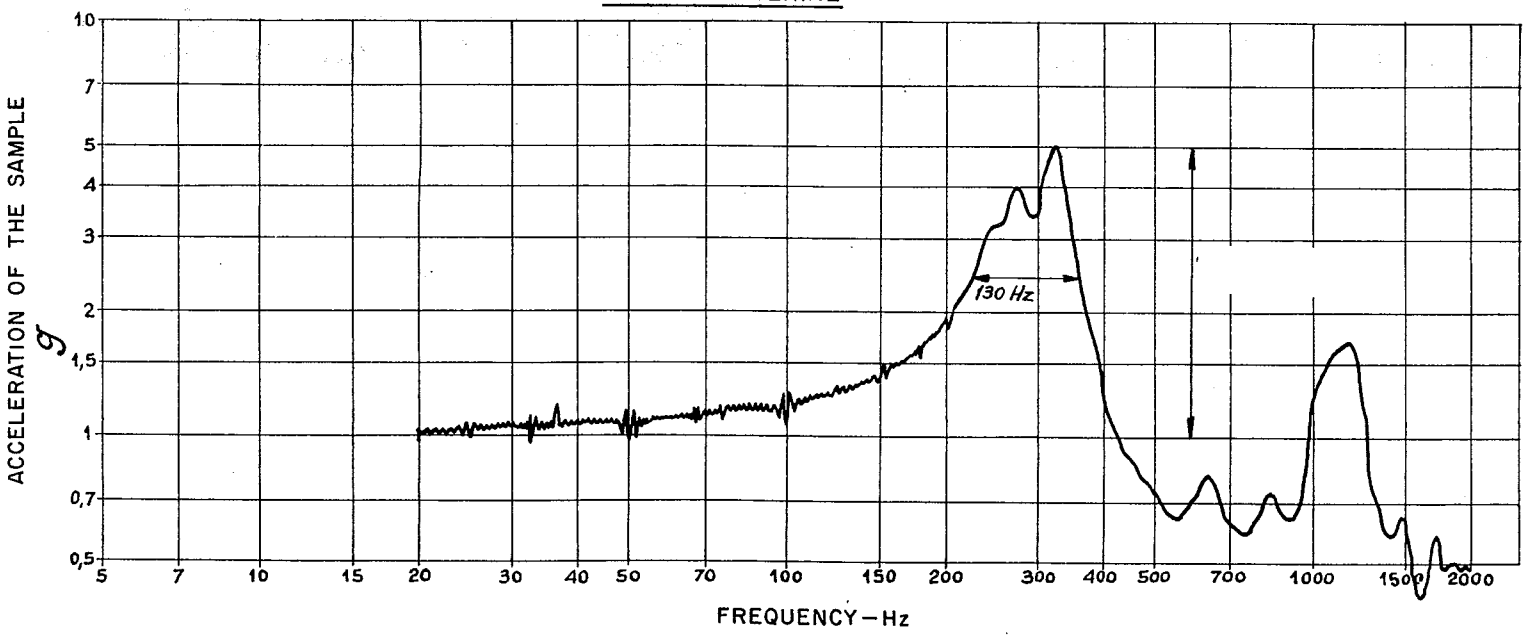

FIG. 12 shows the resonance curve of one of the materials which have been studied, the frequency in Hertz being recorded in abscissa and the amplitude in *g* (acceleration of the Earth's gravity) on the ordinate axis, according to logarithmic scales.

Figure 13:
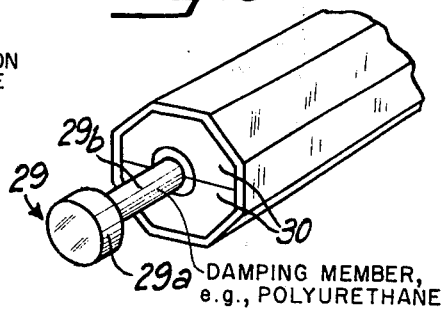
Figure 14:
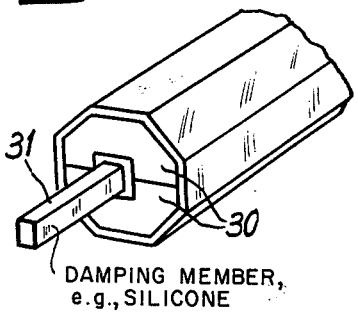

FIGS. 13 and 14 are schematic perspective views of two amortizing systems fitted to the end of the handle of a tennis racket. On FIG. 13 the amortizing system has a variable cross-section. On FIG. 14 it has an oblong cross-section, for instance rectangular, with which different resonance frequencies can be achieved if the excitation is parallel to the greater or smaller axis of the cross-section.

Figure 15:
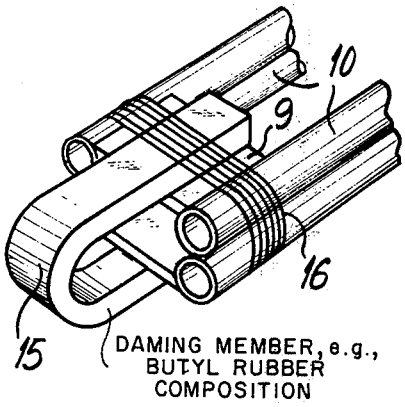

FIG. 15 is a perspective view of the end of the frame of a metal racket fitted with an amortizing system consistent with the present invention, and bound to the brace holding together the parallel limbs at the end of the frame.

FIGS. 16 to 20 show the fitting of an amortizing system, according to the present invention, on a metal racket, the folded band being kept in place by the shells making up the handle of the racket.

Figure 20:
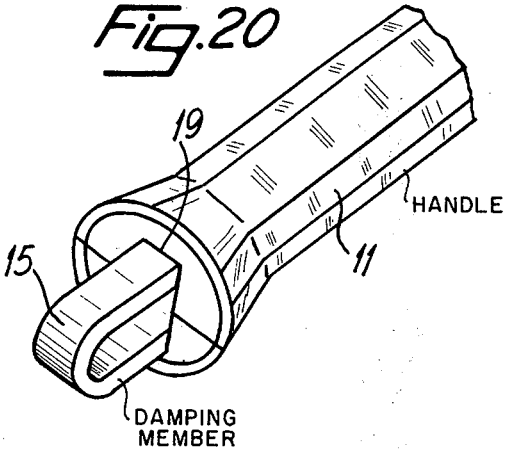
Figure 21:
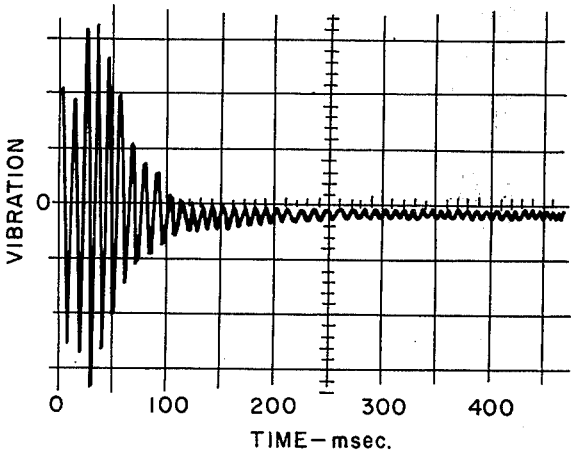

FIG. 21 shows, as a function of time, the amplitude of the vibrations of a racket fitted with an amortizing system made of a silicone band fitted as described in FIGS. 16 to 20.

Figure 22:
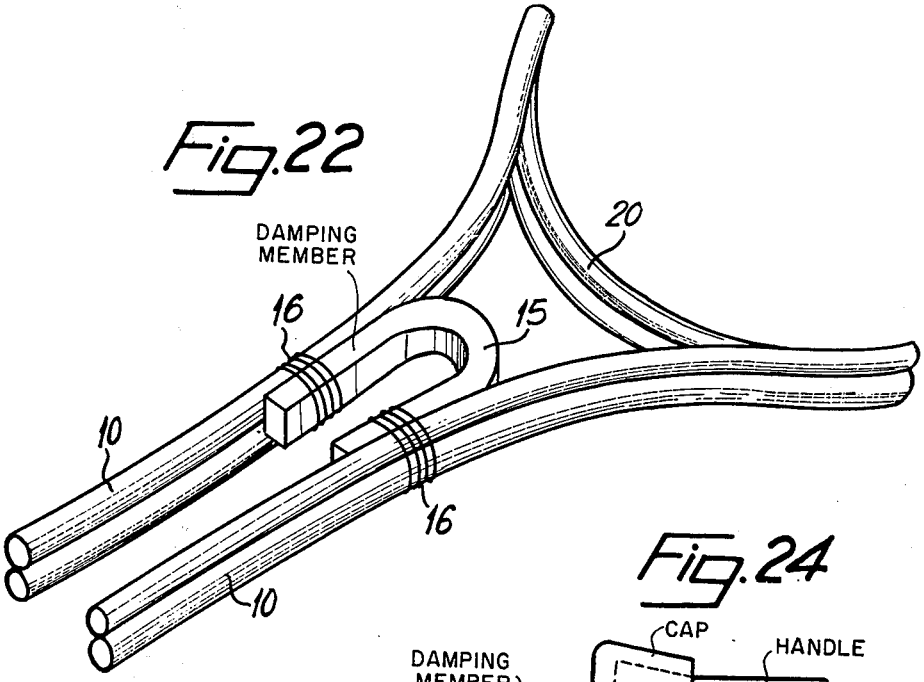
Figure 23:
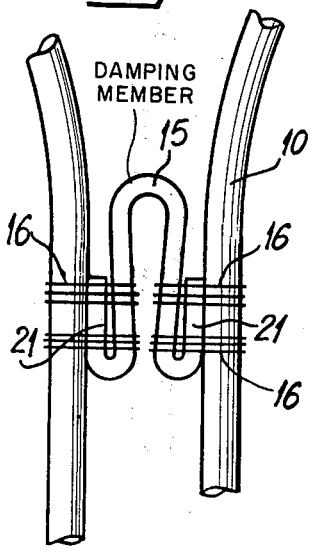

FIGS. 22 and 23 show, one in perspective and one in cut-out view, two possible fittings of an amortizing system near the "throat" of a racket.

Figure 24:
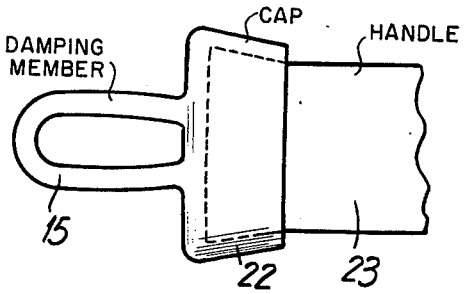

FIG. 24 shows in cut out view an amortizing system part of a cap which can be adapted to the handle of an implement.

Figure 25:
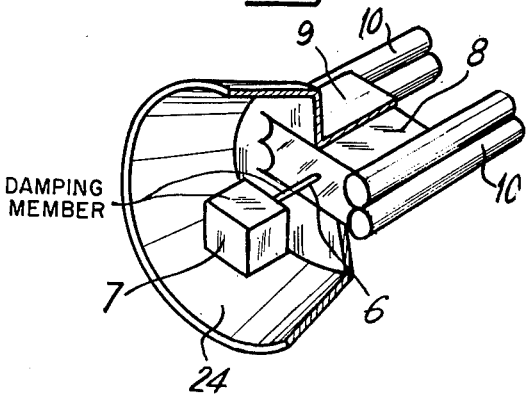

FIG. 25 shows, in perspective, the brace in the handle of a racket designed to protect the amortizing system.

FIG. 26 shows, again in perspective, a cylindrically shaped amortizing system fitted, for example, to the end of a baseball bat.

Figure 27:
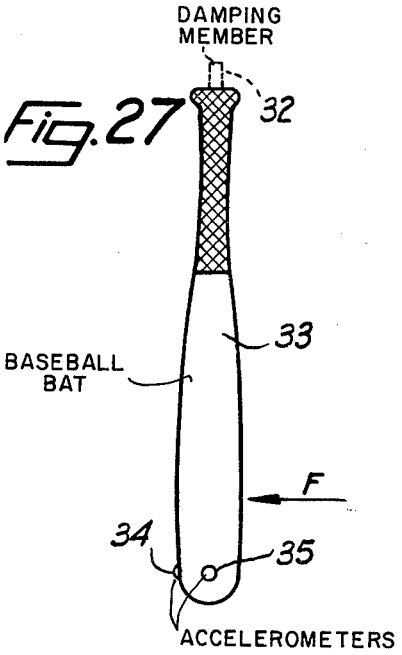
Figure 28:
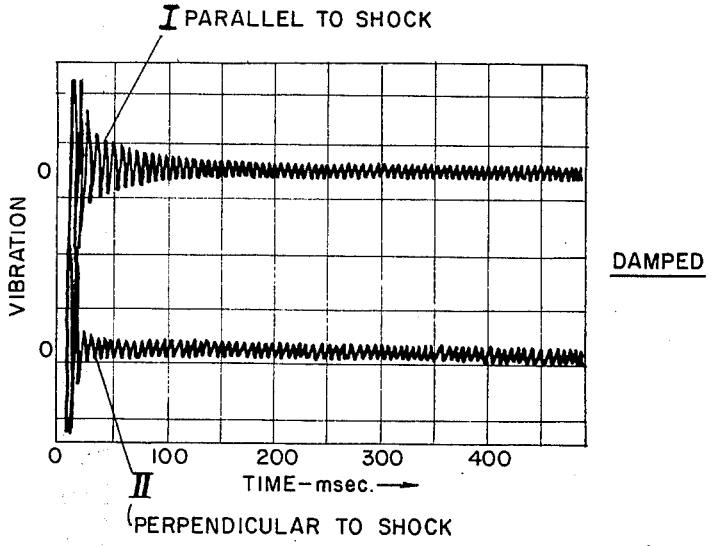
Figure 29:
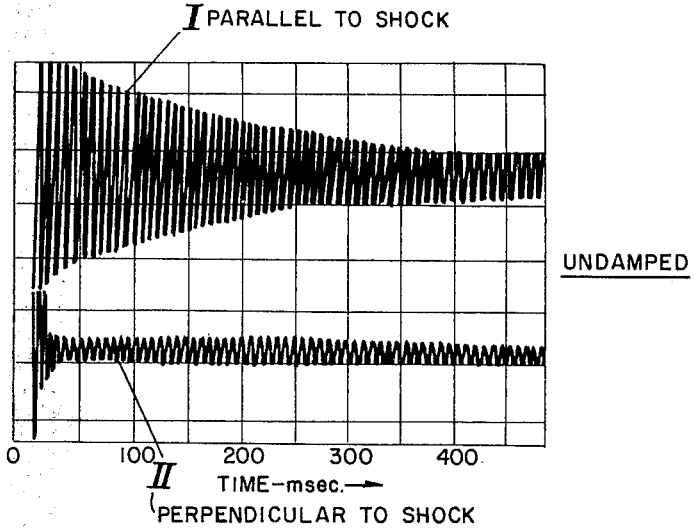

FIG. 27 is a sketch showing the location of the amortizing system, of the accelerometers and of the shocks applied to the bat, to make the recordings shown on FIGS. 28 and 29.

Figure 26:
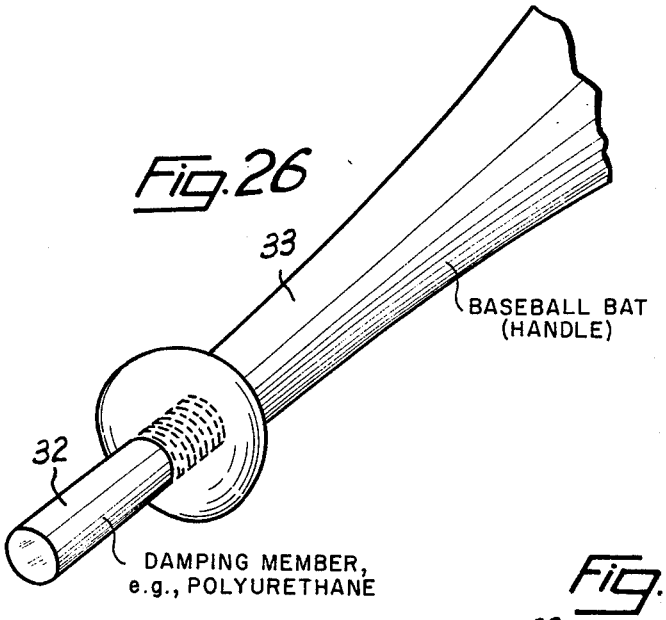

FIGS. 28 and 29 are recordings showing, as a function of time, the amplitude of the vibrations of a metallic baseball bat respectively with or without an amortizing system similar to that shown on FIG. 26. (The curves I and II are, in fact, much closer than what has been represented, to avoid darkening the drawing).

Figure 30:
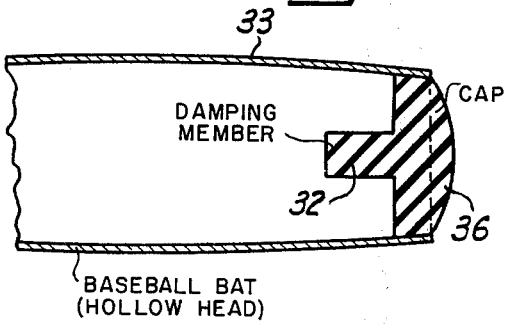

FIG. 30 is a partial cut-out view of a hollow baseball bat with an amortizing system, for example of a cylindrical shape, which is an integral part of the plug fitted to the top of the bat.

Figure 31:
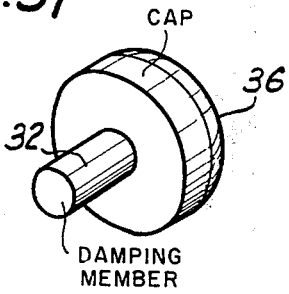

FIG. 31 is a perspective view of this plug.

The experimental study of the vibrations of the frame of a tennis racket can be easily achieved with miniaturized accelerometers (for instance type 22 made by Endevco Company) giving signals which are analysed with the help of an oscilloscope with several channels completed with a Polaroid camera.

Such accelerometers are so light (their weight goes from 0.5gr to 2gr) that they hardly disturb the vibrations which one wishes to study while having the necessary sensitivity and band width.

By placing accelerometers at different spots on the frame, it is possible to establish the law governing the repartition of the amplitude of the vibrations after a given impulsion.

For example the signals 1, 2, 3, and 4 given by 4 accelerometers glued to the frame of the racket 5 at the spots indicated $A_1$, $A_2$, $A_3$ and $A_4$ on FIG. 1 are shown by the graphics of FIG. 2 reproducing those shown on the oscilloscope connected to the accelerometers. For the experiment, the racket was held by its part B at about 18 centimeters from the handle end of the frame and the strings were struck at a spot C approximately equidistant from the center of the stringing and its top end, and the speed of the oscilloscope sweep had been set at 5 milliseconds for each division.

If the vibrations of high frequency coming from the stringing are disregarded, one notices on this FIG. 2 that the signals 1, 3 and 4 have similar amplitudes while the signal 2 has a very low amplitude. One also notices that signal 3 has a phase opposed to those of signals 1 and 4.

Several tests showing similar charts permit one to conclude with certainty that the main vibration of the frame is a vibration in which the frame flexes in a direction perpendicular to the plane of the strings with two "nodes" (or spots of small vibration):

— one on a line passing by the center of the stringing ($A_2$)

—one at the beginning of the grip, at about 18 cm from the end of the handle for most rackets (B)

and three "anti-nodes" (or spots of high vibration)

—one at the top of the racket ($A_1$)

—one near the throat of the racket ($A_3$)

—one at the end of the handle of the racket ($A_4$)

The inventor has found that one could successfully amortize this vibration by an oscillating system excited by it and placed near one of the 3 "anti-nodes", the existence of which has just been demonstrated.

It is possible to achieved this result by attaching to the racket an oscillating system having in itself a strong amortization and a frequency of oscillation properly set in relation to the frequency of the vibration of the frame.

The theory of the oscillations of such a system is quite classical. Let us simply recall that:

—the amplitudes of the free oscillations decrease exponentially with time

—the apparent frequency of the free oscillations is not much different from the frequency of the non amortized system as long as its inherent amortization is not too close to the critical amortization.

—the amplitude of forced oscillations reach a maximum (resonance) when the frequency of the external vibration is the same as the frequency of the non amortized system and this maximum being all the higher if the system is less amortized.

—the energy dissipated in the oscillating system is proportionate to the square of the amplitudes of the oscillations: it is thus advantageous to achieve a system permitting large amplitudes.

—the amplitude of the forced oscillations, when the system was initially at rest, reach its maximum only after a number of periods all the more numerous if the system is less amortized.

The result is that a compromise is necessary regarding amortization if one wishes to achieve the greatest absorption of energy in a given time.

When the initial impulsion is produced by a shock, the movement of the amortizer is the combination of:

—a free oscillation of decreasing amplitude,

—a forced oscillation of increasing amplitude.

Here again a compromise is necessary if one wishes to prevent the amortizer from striking some adjacent part or from receiving too large stresses.

The FIGS. 3 and 4 show two views of an amortizing system adapted, in a racket 5, at the end of the handle, i.e. at the third anti-node of the vibrations.

This system is made of a steel wire (6) of 1 millimeter diameter, one end carrying a small weight 7 of any suitable material such as lead or tungsten, weighing about 4.5 gr and the other end being struck into a volume (8) made of a mixture of about 100 parts of butyl for 20 parts of silicate of aluminium weighing about 4 gr and filling the inside of a hollow brace (9) assembling the two ends of the tubing of the frame which are used to make the handle in a way well known now.

The oscillating part of the system, made of the wire and the weight can be set in frequency by changes in the length of the wire, while the absorption of energy is achieved by the action of the rubber mixture in which the wire is stuck.

On FIGS. 5 and 6 which show from different directions a part of one of the plastic shells (11) which are placed on the ends of the frame to complete the handle, one will notice the small cutting (12) made on the partition (13), which contacts the brace (9), and giving room for the wire.

To set the frequency of the amortizer itself in relation to the frequency of the vibrations of the racket it is easy to search for the quickest amortization of the vibrations produced by a light shock of the head of the racket on the ground by bringing the weight (7) closer or further from the supporting element (8).

One appraises the speed of the decrease of the vibration by holding lightly the handle by two fingers.

FIGS. 7 and 8 show the signals given by an accelerometer placed at the top of a racket ($A_1$ on FIG. 1) held and struck as for the experiment giving the results shown on FIG. 2.

FIG. 7 relates to a racket without an amortizing system.

FIG. 8 relates to a racket identical to the former one but completed by the system described above, the length of the steel wire between the weight and the amortizing mixture being set at about 8 mm.

The comparison between FIGS. 7 and 8 for which each division represents 50 milliseconds shows that thanks to the amortizing system the vibration has entirely disappeared in less than 250 ms/sec while, without it, the vibration is still noticeable after a time twice as long.

FIGS. 9 and 10 show the signals given by an ultraminiaturized accelerometer (weight less than 0.5gr) glued on the small weight of the system, when one lets the weight oscillate freely after having drawn it away from its equilibrium position.

FIG. 9 for which each division represents 5 mm sec. has been obtained with the amortizer used and set as for the experiment of FIG. 8. One sees that the proportion of the amplitude of the vibration from one period to the next one is about ⅓.

One also sees that the frequency of this vibration is about 100 Hertz as for the racket itself.

FIG. 10 for which each division also represents 5 mm sec. has been obtained by doubling the distance between the weight and the amortizing mixture. In this case the frequency shown is around 45 Hertz, and one finds experimentally that the vibration of the racket is not amortized faster than in conditions shown by FIG. 7: the difference between the frequency of the amortizing system itself and the frequency of the frame is too great to permit the amortization to be significant.

On FIG. 11, the sample 25 of the material to be studied has a cylindrical shape and is mounted by a support 26 on a vibration source 27. The vibration amplitude at the free end of the cylindrical sample is measured by a small accelerometer 28 struck on it.

The theory of the vibrations of a cylinder is quite classical. Let us simply recall that, for a given material, the frequency of the lower resonance is proportional to the diameter and to the inverse square of the length of the cylinder. Thus the adjustment of the dimensions of the cylindrically shaped amortizing system is specially simple to calculate.

The most interesting characteristic obtained by analysing curves such as FIG. 12 is the coefficient of resonance, i.e. the ratio between the maximum amplitude recorded at the free end of the sample and the amplitude of excitation: by varying this coefficient, it is possible to search for the best compromise to achieve the maximum energy dissipation during a given time. For an implement having a vibration frequency of about 100 Hertz as, for example, the tennis rackets studied above, it is advantageous to use a material amortizing more, thus having a smaller resonance coefficient, than for an implement having a vibration frequency of about 300 Hertz as a baseball bat.

Another characteristic, moreover related to the first one, is the width of the resonance curve which indicates in what frequency range the amortizing system can act efficiently: the higher the resonance coefficient, the narrower the resonance curve and vice-versa. This characteristic gives the information necessary to know the tolerance in the dimensions of the system for obtaining a reproducible amortizing.

A last characteristic useful to know is the variation with the temperature of the resonance frequency: according to the implement, the temperature range inside which the amortizing system must work properly is more or less wide (for instance, for tennis or baseball, this range is approximately between 5° and 40° centigrade).

FIG. 12 has been obtained with a RP40 silicone elastomer sample made by Rhone Poulenc Company, having a length of 17mm and a diameter of 20mm. The resonance coefficient is approximately 5. The width of the resonance curve at half amplitude is 130 Hertz. By recording similar curves for different temperatures, it is possible to prove that for RP40 silicone the resonance frequency changes by less than 10% in the temperature range 5°–40° centigrade.

The amortizing system 29 shown on FIG. 13 has been made of ADIPRENE by DU PONT de NEMOURS, a synthetic elastomer derived from linear polyurethane, sold in France under the same ELADIP 420. This material, less flexible than RP40 silicone, has excellent mechanical properties which greatly simplify its attachment. The amortizing system 29, which has an axis of symmetry, displays a variable cross-section, smaller near its attachment point, which makes possible, for a given mass and length, a lower resonance frequency than with a cylindrically shaped system. The attachment is made by embedding the rod **29*b* between the shells 30** which make the handle of the implement, for instance on tennis rackets.

If one wishes to obtain a lower resonance frequency, part **29*a*, at the end of rod 29*b***, can be made of a denser material, for instance lead or tungsten.

The amortizing system 31, shown on FIG. 14, can be made of RP40 silicone. For a tennis racket in which the main vibration frequency, of approximately 100 Hertz, is accompanied by a secondary vibration perpendicular to the first one, of frequency 90 Hertz, the optimal dimensions are: length 21 mm (from the attachment point), cross-section 10 × 11 mm, the larger side being perpendicular to the plane of the stringing.

On FIG. 15, the oscillating amortizing system of a metal racket is a band 15 made of an elastic and damping material such as rubber, for example a mixture of 100 parts of butyl rubber and 20 parts of sodium aluminium-silicate. This band is folded in the shape of an U and its branches by means of binding 16, in a plane perpendicular to the stringing, are fastened to the brace 9 which holds together the parallel limbs 10 which are part of the handle. The curved part of the U stands out of the handle.

The dimensions of the band and its binding points are chosen so that the amortizing is maximum.

FIGS. 16 to 20 show a very simple way for incorporating an U shaped amortizing system in the handle of a racket.

Figure 16:
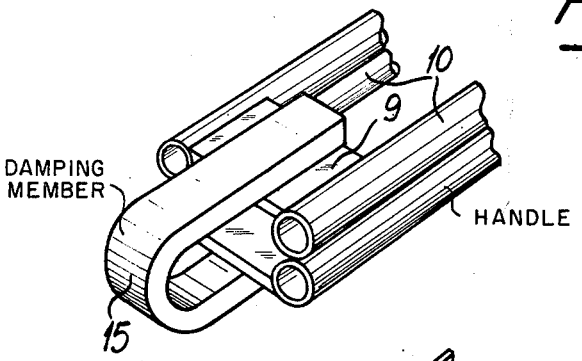
Figure 17:
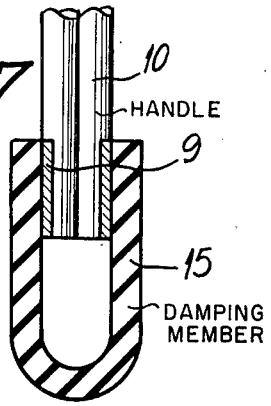
Figure 18:
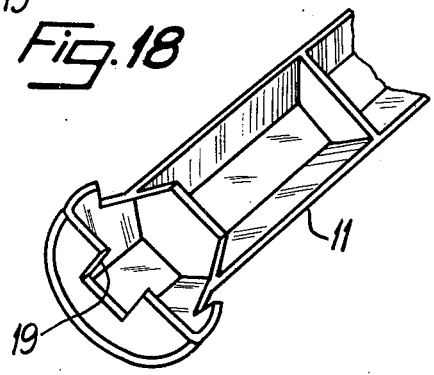
Figure 19:
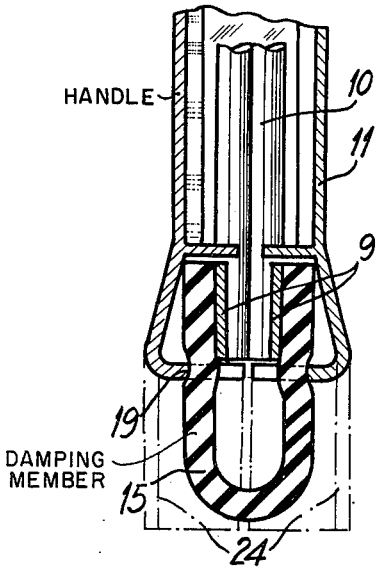

The band 15 shown in perspective on FIG. 16 and in cut-out view on FIG. 17, lying on brace 9, as on FIG. 15 is simply kept in place by the two shells 11 making up the handle. To this end the aforesaid shells each have a slot 19 which is easily seen in perspective in FIG. 18. These slots are designed so that the shells grip around the band and wedge it against the brace as shown in FIG. 19, which is a cut-out view in a plane perpendicular to the stringing.

FIG. 20 shows in perspective the curved part of band 15 standing out of the handle of the racket.

With this example, as with all the precedent ones, remarkable results are observed when band 15 is made with a silicone elastomer.

The tests described in FIGS. 7 and 8 were repeated with a racket fitted with a band of silicone elastomer RP40, made by Rhone Poulenc Company, having a length of 91 mm, a cross section of 9.5 × 5 mm and weighing only 5 gramm. This band was assembled as described on FIGS. 16 to 20. The part of the U standing out of the handle had a length of 22 mm.

FIG. 21, obtained in a similar way as in FIG. 8 of the initial application, (each division equals 50 msec) shows that the amortizing is even faster. The frequency of the amortizing system is about 100 Hertz as that of the racket.

The hardiness of these amortizing systems enables their mounting on different parts of the racket.

On FIG. 22, band 15, U-shaped, is fitted near the middle vibration anti-nodes of a metal racket, between the two limbs 10 of the frame near the brace 20 which completes it. The curved part of the U faces the brace. The band is fastened to the limb 10 by the bindings 16.

On FIG. 23, band 15 is fastened on the same limbs, after folding on itself each branch 21. The fastening is again made by the bindings 16.

In the two aforesaid examples good results are obtained when the bands are made of butyl rubber or silicone elastomer as described above.

On FIG. 24 the oscillating part 15 is part of a cap 22 designed so that it can be fitted on a suitable protrusion inside or outside the implement for example on its handle. The oscillating part and the cap itself can be conveniently made as a single piece by moulding.

FIG. 25 shows how the end of the handle can be designed to protect the amortizing system. In the example shown the amortizing system is of the type described with reference to FIGS. 3 and 4.

The brace 9 holding together the two limbs 10 of the racket frame and inside which is placed the support 8 embodies a protecting part 24 inside which the weight 7 can oscillate freely. This protecting part could be made by any other means, for example as an extension of shells 11, as shown in dotted lines on FIG. 19.

The amortizing system 32, shown on FIG. 26, can be made of ELADIP 183, a softer type of ADIPRENE than ELADIP 420. For a metallic baseball bat 33, having a main vibration of frequency 300 Hertz, the optimal dimensions are: length 27 mm (from the attachment point) and with a diameter of 20 mm.

FIG. 27 shows a baseball bat 33 which was used to record the curves shown in FIGS. 28 and 29. The shock was applied according to the arrow F. and the vibrations were measured with a first accelerometer 34 along the direction of the shock and a second accelerometer 35 along a perpendicular direction. On the curves, each square along the abscissa represents 50 msec. Curve I relates to the vibrations parallel to the shock and curve II relates to the vibrations perpendicular to the shock.

FIG. 28 shows that, because of the amortizing system, all vibration has disappeared in less than 100msec while FIG. 29 shows that, without it, a sizeable vibration remains after 500 msec.

The amortizing system shown in FIG. 26 is specially simple to attach. For example, it is possible to thread the inside of the cylindrical handle and to screw-in the amortizing cylinder. As for the system shown in FIG. 3 it is possible to lower the resonance frequency without increasing its length by using a denser end.

If one wished to make a system which does not protrude from the end of the handle, which can inconvenience some players, it is possible to fit the amortizing system inside the bat, which in most cases is hollow, near one of the other antinodes.

FIGS. 30 and 31 show such a system in the case of a hollow metallic baseball bat 33.

The amortizing system 32 is part of a plug 36 which is crimped at the end of the bat opposite to the handle. Because of the large magnitude of the shocks applied during play, the material used must have excellent mechanical properties which is the case, for example, for the various types of ELADIP aforesaid.

The examples shown above are not in the slightest way restricted to implements for tennis and baseball. In particular similar amortizing systems could be made for cricket bats or for any other implement subject to repetitive shocks.

What I claim is:

1. An elongated sports implement comprising a striking portion at one end and a handle portion of lesser breadth than said striking portion at its other end, said implement having a longitudinal axis which passes through said striking portion and said handle, said implement being subject in use to significant vibration extending to said handle portion from impacting contact with a game ball at said striking portion, said vibration being transverse to said longitudinal axis and having an alternating series of two nodes and three antinodes spaced along said axis, one of said antinodes being located at each of said ends of said implement, and a cantilevered vibration damper comprising an elongated resilient member having a longitudinal axis, said member having one end attached to said implement at the location of one of said antinodes, with the longitudinal axis of said member generally parallel to the longitudinal axis of said implement, the opposite end of said member being free to vibrate, said member being formed of an energy-absorbing material and being so configured and dimensioned that its natural frequency of vibration corresponds to the frequency induced in the implement during said vibration, whereby said vibration is significantly damped.

2. An implement in accordance with claim 1 in which said member has at least a portion having a circular cross-section.

3. An implement in accordance with claim 1 in which said member has a variable cross-section which is smaller at the point of attachment to said implement and larger at its free end.

4. An implement in accordance with claim 1 in which said member has at least a portion having a rectangular cross-section.

5. An implement in accordance with claim 1 in which said elongated member comprises a weighted relatively non-flexible portion at the free end of said member and a flexible connecting portion between said weighted portion and the point of attachment of said member to said implement.

6. An implement in accordance with claim 5 in which said flexible portion is made of a material selected from the group consisting of linear polyurethanes, silicone elastomers, or butyl rubber.

7. An implement in accordance with claim 6 in which at least part of said flexible connecting portion has a circular cross-section.

8. An implement in accordance with claim 6 in which at least part of said flexible connecting portion has a rectangular cross-section.

9. An implement in accordance with claim 5 in which said elongated member is integrally formed of a single homogeneous material.

10. An implement in accordance with claim 9 in which said material is selected from the group consisting of linear polyurethanes, silicone elastomers, or butyl rubber.

11. An implement in accordance with claim 5 in which said connecting portion and said weighted portion of said elongated member are generally cylindrical, said weighted portion having a diameter at least equal to that of said connecting portion.

12. An implement in accordance with claim 5 in which said elongated member is formed of different materials, said weighted portion having a greater density than that of said connecting portion.

13. An implement in accordance with claim 1 in which said member is entirely enclosed within said implement.

14. An implement in accordance with claim 2 in which said member is U-shaped, the arms of the U being attached to said implement and the trough of the U being free to vibrate.

15. An implement in accordance with claim 1 in which the cross-section of said U-shaped member is rectangular.

16. An implement in accordance with claim 1 which is a tennis racket having a head constituting said striking portion, a handle portion and a throat portion interconnecting said head and said handle portion, an antinode existing at the free end of said handle and within said heart portion, said member being attached to one of said handle free end and said heart portion at the location of the antinode present therein.

17. A tennis racket in accordance with claim 16 in which said member has a circular cross-section.

18. A tennis racket in accordance with claim 16 in which said member has a variable cross-section which is smaller at its point of attachment to said handle and larger at its free end.

19. A tennis racket in accordance with claim 16 in which said member has a rectangular cross-section.

20. A tennis racket in accordance with claim 16 in which said handle portion comprises two parallel limbs and a transverse brace interconnecting said limbs, said elongated member being attached to said brace.

21. A tennis racket in accordance with claim 16 in which said member protrudes from the free end of said handle, and said handle comprises a protective guard surrounding said member.

22. A tennis racket in accordance with claim 16 including a cap adapted for connection to the free end of said handle, said cap forming the point of attachment of said member to said racket.

23. An implement in accordance with claim 1 which is a baseball bat comprising a handle portion and a ball striking portion connected thereto, each of said handle portion and said striking portion having a free end, said member being connected to one of said free ends.

24. An implement in accordance with claim 1 which is a tubular baseball bat comprising a handle portion, a ball striking portion, and a plug closing the open end of said ball striking portion, said member being integrally formed on said plug and being enclosed entirely within said bat.

* * * * *